US009559460B2

(12) United States Patent
Kataoka et al.

(10) Patent No.: US 9,559,460 B2
(45) Date of Patent: Jan. 31, 2017

(54) LEVER-TYPE CONNECTOR WITH REGULATING PROTRUSION ON MALE HOUSING THAT ENGAGES LEVER ON FEMALE HOUSING TO ACHIEVE CONNECTION WITHOUT INCLINATION BETWEEN MALE AND FEMALE HOUSINGS

(71) Applicant: Sumitomo Wiring Systems, Ltd., Yokkaichi, Mie (JP)

(72) Inventors: Shigeto Kataoka, Mie (JP); Hideto Nakamura, Mie (JP); Tomonari Itou, Mie (JP); Takashi Matsuda, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/941,967

(22) Filed: Nov. 16, 2015

(65) Prior Publication Data

US 2016/0141799 A1 May 19, 2016

(30) Foreign Application Priority Data

Nov. 17, 2014 (JP) ..... 2014-232390

(51) Int. Cl.
*H01R 13/62* (2006.01)
*H01R 13/629* (2006.01)

(52) U.S. Cl.
CPC ... *H01R 13/62938* (2013.01); *H01R 13/62955* (2013.01)

(58) Field of Classification Search
CPC ..... H01R 31/62933; H01R 13/62938; H01R 13/62955; H01R 13/62988; H01R 13/64; H01R 13/629; H01R 13/62977
USPC ..... 439/157, 372
See application file for complete search history.

(56) References Cited

U.S. PATENT DOCUMENTS 5,839,912 A * 11/1998 Schekalla ..... H01H 50/048 439/157
6,354,852 B2 * 3/2002 Noro ..... H01R 13/62938 439/157
6,669,509 B2 * 12/2003 Ichida ..... H01R 13/5219 439/157
6,905,355 B2 * 6/2005 Fukamachi ..... H01R 13/62933 439/157
7,300,294 B2 * 11/2007 Fukatsu ..... H01R 13/62955 439/157

(Continued)

FOREIGN PATENT DOCUMENTS

JP 2004-14142 1/2004

*Primary Examiner* — Hae Moon Hyeon
(74) *Attorney, Agent, or Firm* — Gerald E. Hespos; Michael J. Porco; Matthew T. Hespos

(57) ABSTRACT

A lever-type connector has a female housing (F) with a tubular fitting (13) that includes a lever accommodating portion (15) for accommodating a lever (30) and an inner regulating wall (16) on a side opposite to the lever accommodating portion (15). A male housing (M) has a receptacle (43) with an outer regulating wall (44) facing the inner regulating wall (16), and has a supporting wall (45) facing the lever accommodating portion (15). A cam follower (47) and a regulating protrusion (48) are formed on an outer surface of the supporting wall (45) and can contact the lever (30) by being inserted into an opening (23) of the lever accommodating portion (15). Contact of the regulating protrusion (48) and the lever (30) regulates inclination of the housings (F, M) in the process of rotating the lever (30).

6 Claims, 8 Drawing Sheets

(56) References Cited

U.S. PATENT DOCUMENTS

| | | | | |
|---|---|---|---|---|
| 7,407,397 | B2 * | 8/2008 | Fukatsu | H01R 13/62938 439/157 |
| 2007/0026709 | A1 * | 2/2007 | Fukatsu | H01R 13/62955 439/157 |
| 2016/0141789 | A1 * | 5/2016 | Kataoka | H01R 9/24 439/660 |

* cited by examiner

LEVER-TYPE CONNECTOR WITH REGULATING PROTRUSION ON MALE HOUSING THAT ENGAGES LEVER ON FEMALE HOUSING TO ACHIEVE CONNECTION WITHOUT INCLINATION BETWEEN MALE AND FEMALE HOUSINGS

BACKGROUND

1. Field of the Invention

The invention relates to a lever-type connector.

2. Description of the Related Art

Japanese Unexamined Patent Publication No. 2004-014142 discloses a lever-type connector configured so that a male housing including a receptacle and a female housing including a terminal accommodating portion to be fit into the receptacle are connected by rotating a lever provided on the female housing.

The lever is a single plate and is arranged along an outer wall of the terminal accommodating portion. Further, a clearance for making a connecting operation smooth exists between the peripheral surfaces of the two housings in consideration of dimensional tolerances. Thus, in the process of connecting the two housings, the postures of the two housings may be inclined with an engaged part of a cam groove of the lever and a cam follower of the receptacle as a supporting point. Inclination of the two housings increases sliding resistance between a terminal fitting of the male housing and a terminal fitting of the female housing, and hence also increases connection resistance.

The invention was completed based on the above situation and aims to suppress the inclination of a male housing and a female housing when connecting a lever-type connector configured to connect the two housings by a lever in the form of a single plate.

SUMMARY

The invention is directed to a lever-type connector with female and male housings. The female housing has a block-like terminal accommodating portion and a substantially rectangular tubular fitting surrounds the terminal accommodating portion. A lever is accommodated rotatably in a accommodating portion of the tubular fitting and is substantially in the form of a single plate with a cam groove. The male housing has a substantially rectangular tubular receptacle, and a cam follower is formed on an outer surface of the receptacle. The female and male housings are set in an initial state with the receptacle accommodated shallowly into a connection space between the terminal accommodating portion and the tubular fitting and with the cam follower inserted into an entrance of the cam groove. The lever is rotated from the initial state. As a result, the cam follower and the cam groove generate a cam action that connects the female and male housings. An outer regulating wall of the tubular fitting is arranged on a side opposite to the accommodating portion across the terminal accommodating portion. An inner regulating wall of the receptacle is arranged along an inner surface of the outer regulating wall, and a facing wall of the receptacle is arranged along an inner surface of the accommodating portion and has the cam follower projecting from the outer surface of the facing wall. A regulating protrusion projects from an outer surface of the supporting wall and can contact the lever by being inserted into an opening in the lever accommodating portion. Posture inclination between the female and male housings is regulated by the contact of a tip outer edge of the inner regulating wall and the inner surface of the outer regulating wall and by the contact of the regulating protrusion and the lever in the process of rotating the lever.

A clearance is secured between the inner peripheral surface of the tubular fitting and the outer peripheral surface of the receptacle to make a connecting operation of the two housings smooth, but posture inclination may occur between the two housings due to this clearance. In a state where this inclination is maximized, the tip outer edge of the inner regulating wall of the receptacle contacts the inner surface of the outer regulating wall of the tubular fitting and the outer surface of the supporting wall of the receptacle contacts the inner surface of the lever accommodating portion of the tubular fitting. If the clearance is constant, an angle of inclination becomes smaller as a distance from a base point, which is a contact position of the tip outer edge of the inner regulating wall and the inner surface of the outer regulating wall, to a contact position of the supporting wall side and the lever accommodating portion side becomes longer.

Focusing on this point, the regulating protrusion projects on the outer surface of the supporting wall in the present invention. This regulating protrusion contacts the lever in the lever accommodating portion. The contact position of the regulating protrusion and the lever is more distant from the above-described base point than the outer surface of the supporting wall and a tip inner edge of the lever accommodating portion. Thus, the inclination of the housings can be smaller in the lever-type connector of the invention as compared with a conventional configuration in which the regulating protrusion is not formed and the outer surface of the supporting wall and the tip inner edge of the lever accommodating portion contact in a maximally inclined state.

The regulating protrusion may be connected to a base end part of the cam follower. A pressing force equivalent to connection resistance between the two housings acts on the cam follower that is engaged with the cam groove. Thus, the cam follower may be deformed and inclined. However, the regulating protrusion is connected to the base end part of the cam follower. Therefore, the base end part of the cam follower is reinforced and the inclination and deformation of the cam follower can be prevented.

The receptacle may be cantilevered from a terminal holding portion, and the regulating protrusion may be arranged behind the cam follower in an extending direction of the receptacle. According to this configuration, the regulating protrusion is closer to a base end part of the receptacle than the cam follower. The base end part of the receptacle has relatively high strength due to the connection to the terminal holding portion. Thus, an area of the supporting wall where the regulating protrusion is formed is difficult to deform. Accordingly, the reliability of a function of suppressing the inclination of the two housings by the regulating protrusion is excellent.

The opening serves as a guiding path for causing the cam follower to be inserted into the wall-like accommodating portion. Therefore, the strength of the lever accommodating portion is greater than in the case where a dedicated cut portion for causing the cam follower to be inserted into the wall-like accommodating portion is formed separately from the opening.

DETAILED DESCRIPTION

Figure 4:
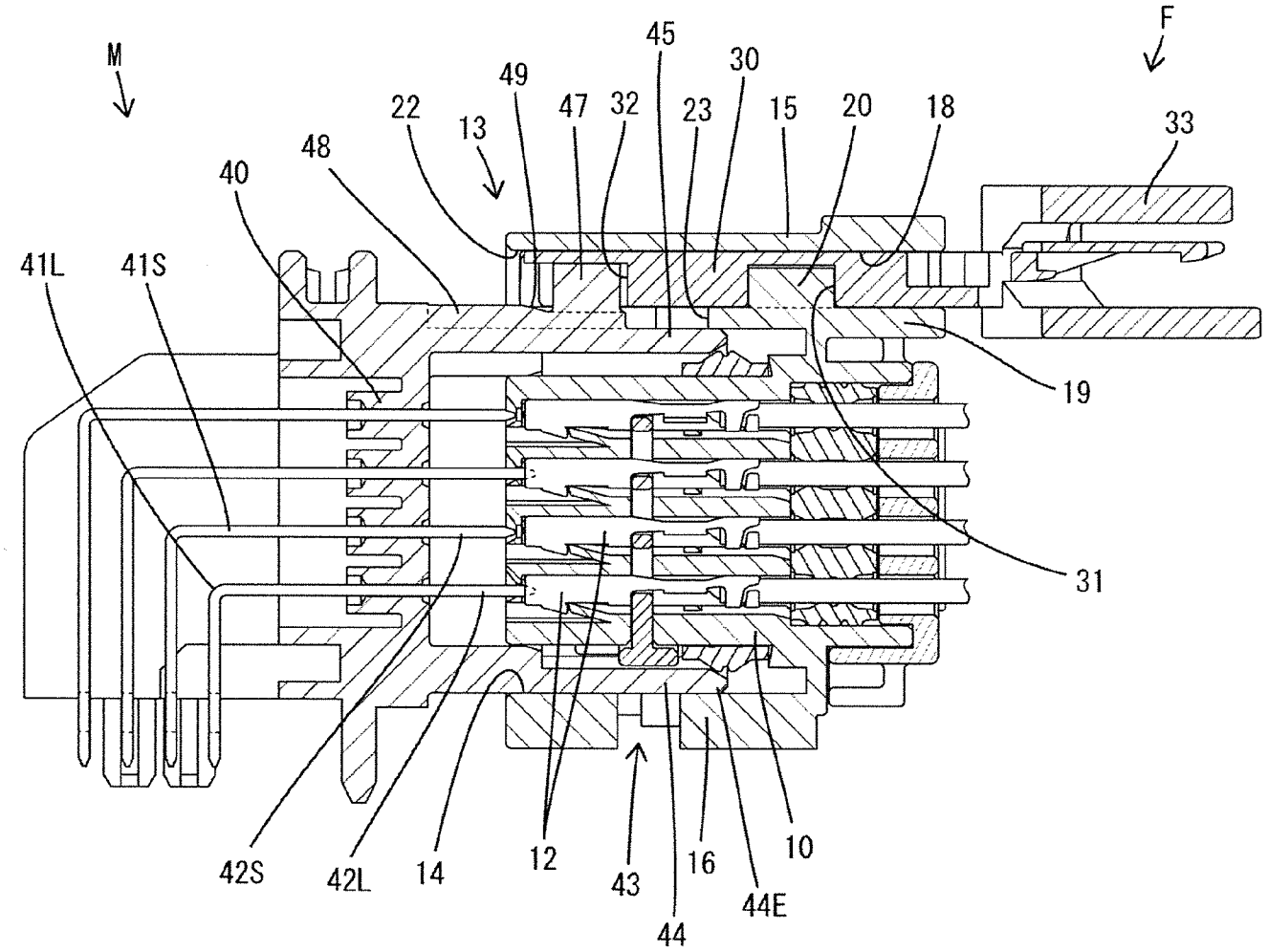
FIG. 4 is a side view in section showing a state where a lever and a regulating protrusion are in contact to regulate the inclination of the two housings in the process of connecting the two housings.
Figure 5:
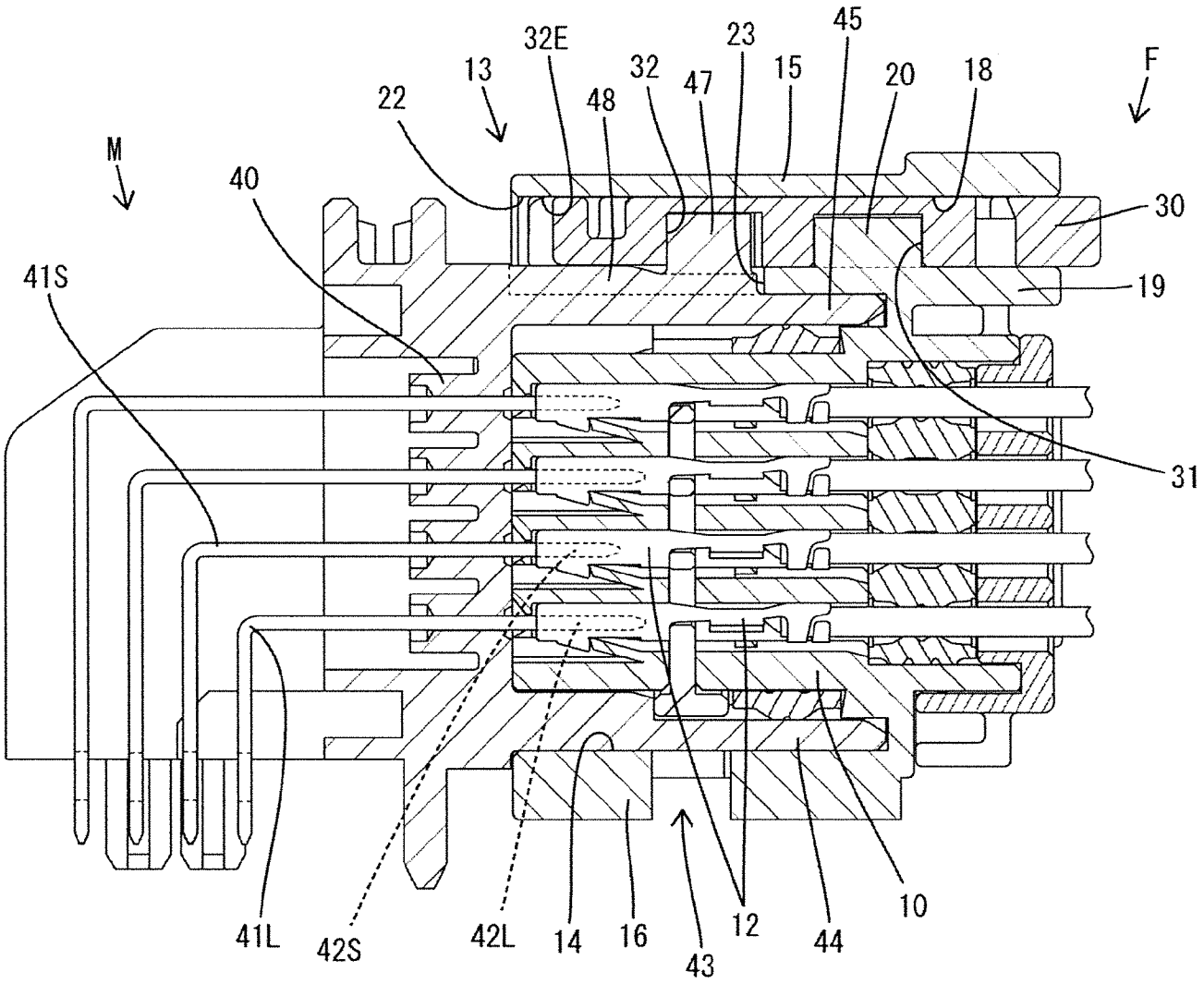
FIG. 5 is a side view in section showing a state where the two housings are connected.

Hereinafter, one specific embodiment of the present invention is described with reference to FIGS. 1 to 8. A lever-type connector of this embodiment is configured such that two female housings F and one male housing M are connected by rotating levers 30 provided on the respective female housings F. Note that since the two female housings F are bilaterally symmetrically formed, one female housing F is described, but the other female housing F is not described in this embodiment. Further, in the following description, a vertical direction is so defined that upper and lower sides shown in FIGS. 3 to 5 are upper and lower sides.

Figure 1:
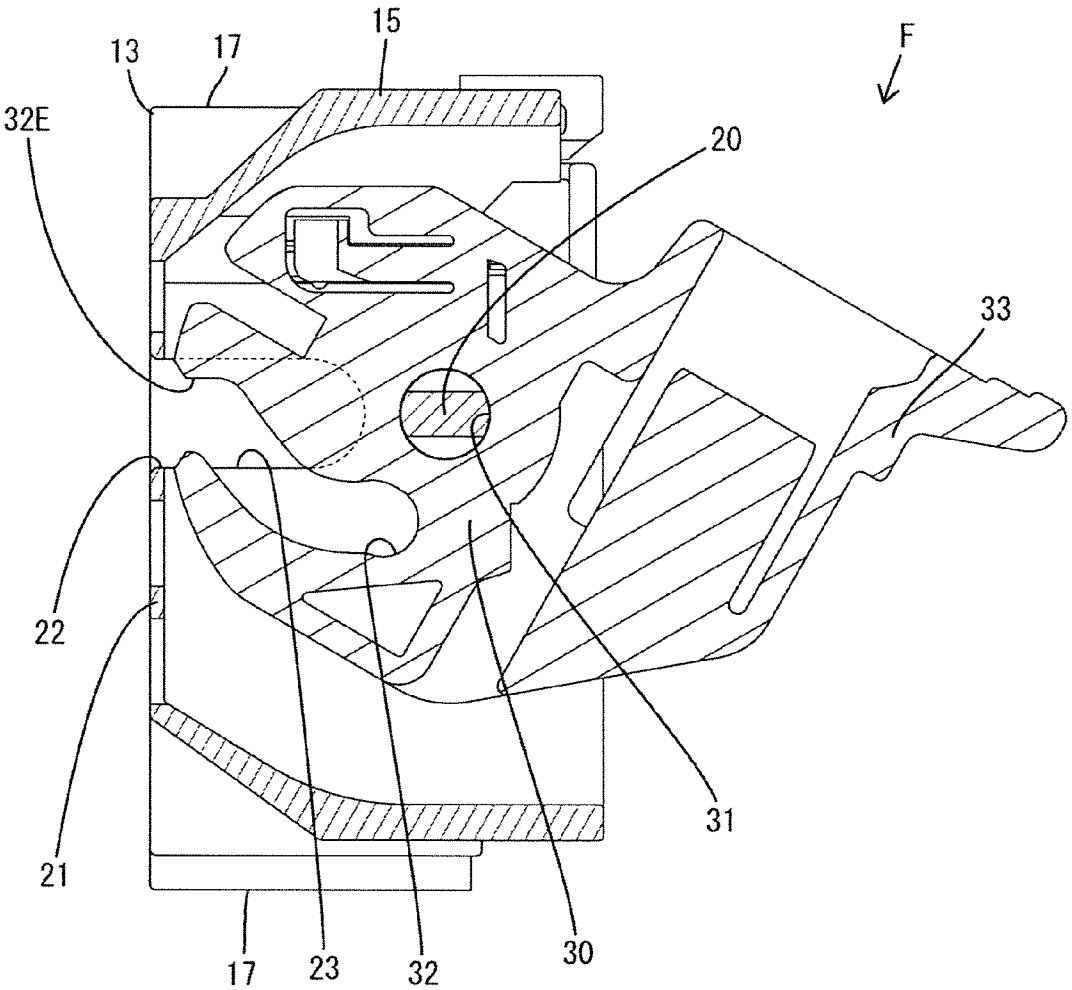
FIG. 1 is a plan view in section of a female housing of one embodiment.
Figure 3:
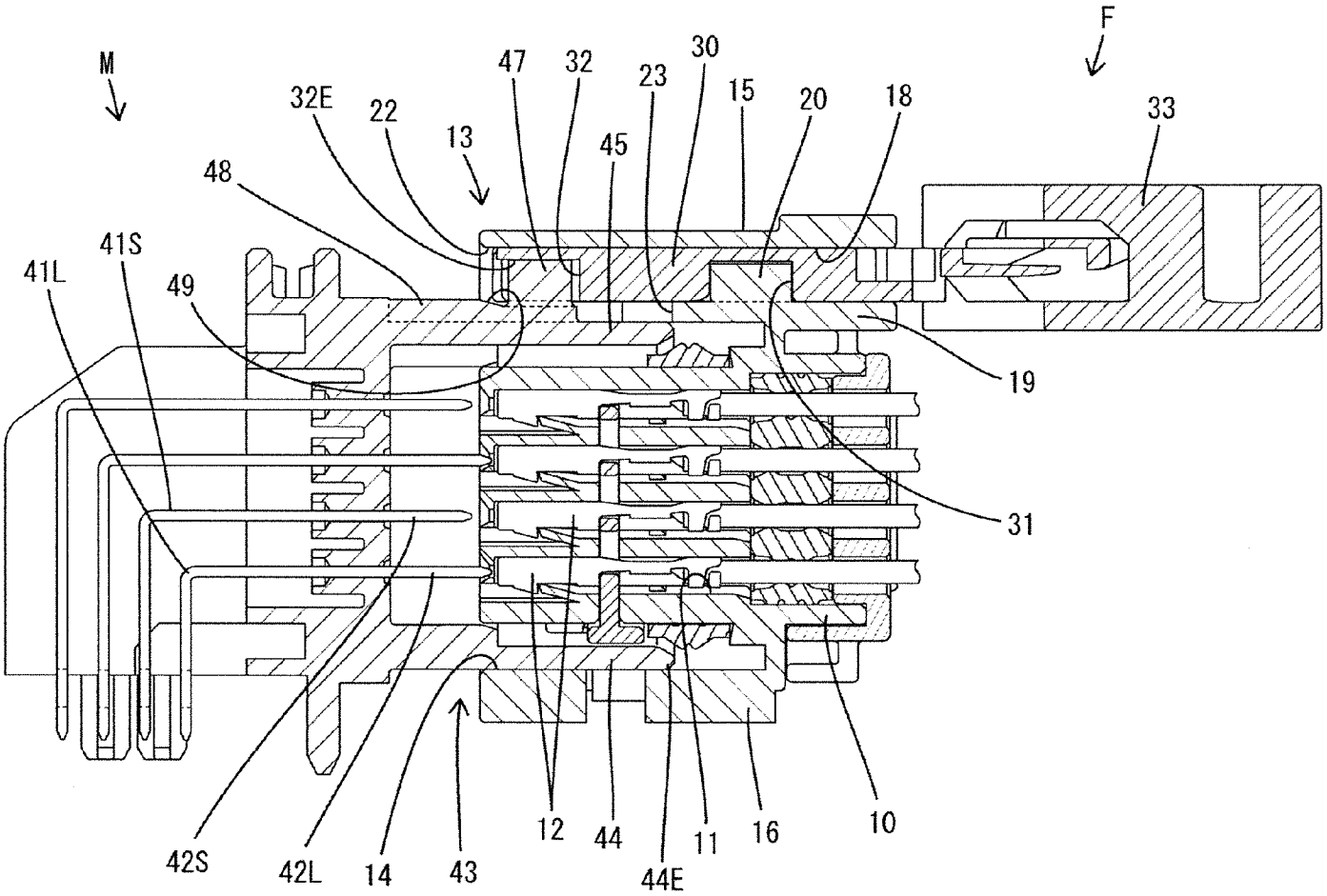
FIG. 3 is a side view in section showing a state where the connection of the two housings is started and a cam follower is inserted in an entrance of a cam groove.

As shown in FIGS. 1 and 3, the female housing F is formed unitarily to include a block-like terminal accommodating portion 10 and a substantially rectangular tubular fitting 13 surrounding the terminal accommodating portion 10. The front ends of the terminal accommodating portion 10 and the tubular fitting 13 are at the same position in a front-back direction that is parallel to a connecting direction of the two housings F, M. Terminal accommodating chambers 11 are aligned in vertical and lateral directions in the terminal accommodating portion 10, and female terminal fittings 12 are inserted respectively into the terminal accommodating chambers 11 from behind. The front ends of all the female terminal fittings 12 are aligned at the same position in the front-back direction.

The terminal accommodating portion 10 and the tubular fitting 13 are connected near rear end parts (right end parts in FIGS. 3-8) thereof. A forwardly open substantially rectangular tubular connection space 14 is formed between the outer periphery of the terminal accommodating portion 10 and the inner periphery of the tubular fitting 13 and is open on the front surface (left surface in FIGS. 2-8). The substantially rectangular tubular fitting 13 is formed by a lever accommodating portion 15 serving as an upper wall, a outer regulating wall 16 and left and right wall-like coupling walls 17. The outer regulating wall 16 is arranged to face the lever accommodating portion 15 across the terminal accommodating portion 10. The left and right wall-like coupling walls 17 connect left and right end edges of the lever accommodating portion 15 and left and right ends of the outer regulating wall 16.

An rearwardly open accommodation space 18 is formed in the lever accommodating portion 15 of the female housing F, and a part of the lever 30 is accommodated in the accommodation space 18. A partition wall 19 of the lever accommodating portion 15 partitions between the accommodation space 18 and the connection space 14. A supporting shaft 20 projects from the upper surface (outer surface) of the partition wall 19 and into the accommodation space 18. The supporting shaft 20 has an axis is aligned with the vertical direction (direction perpendicular to the connecting direction of the two housings F, M), and rotatably supports the lever 30.

A guide opening 22 is open on a front wall 21 of the lever accommodating portion 15 and enables a cam follower 47 and a regulating protrusion 48 to be inserted into the accommodation space 18. An opening 23 that communicates with the guide opening 22 is open on the partition wall portion 19 and extends in the front-back direction (direction parallel to the connecting direction of the two housings F, M). In a width direction (direction perpendicular to both an axial direction of the supporting shaft 20 as a center of rotation of the lever 30 and the connecting direction of the two housings F, M). Formation areas of the guide opening 22 and the opening 23 are in the same range so that the guide opening 22 and that of the opening 23 have equal widths.

The lever 30 is a single substantially horizontal single plate. As shown in FIG. 1, the lever 30 has a bearing hole 31, a cam groove 32 and an operating portion 33. The bearing hole 31 penetrates through the lever 30 in the vertical plate thickness direction. An entrance 32E of the cam groove 32 is open on the outer peripheral edge of the lever 30 and the cam groove 32 forms a path oblique to a circumference centered on the bearing hole 31. The operating portion 33 is formed by causing the outer peripheral edge of the lever 30 to project out.

An area of the lever 30 including the bearing hole 31 and the cam groove 32 is accommodated in the accommodation space 18 with the bearing hole 31 engaged on the supporting shaft 20. The lever 30 is pivotable between an initial position (see FIGS. 3 and 6) and a connection position (see FIGS. 5 and 8) about the supporting shaft 20 and the bearing hole 31. The operating portion 33 projects out from the accommodation space 18 and is gripped to pivot the lever 30. The entrance 32E of the cam groove 32 is open forward toward the male housing M when the lever 30 is at the initial position. In the width direction, the entrance 32E of the cam groove 32 is aligned with the guide opening 22 and the opening 23.

Figure 2:
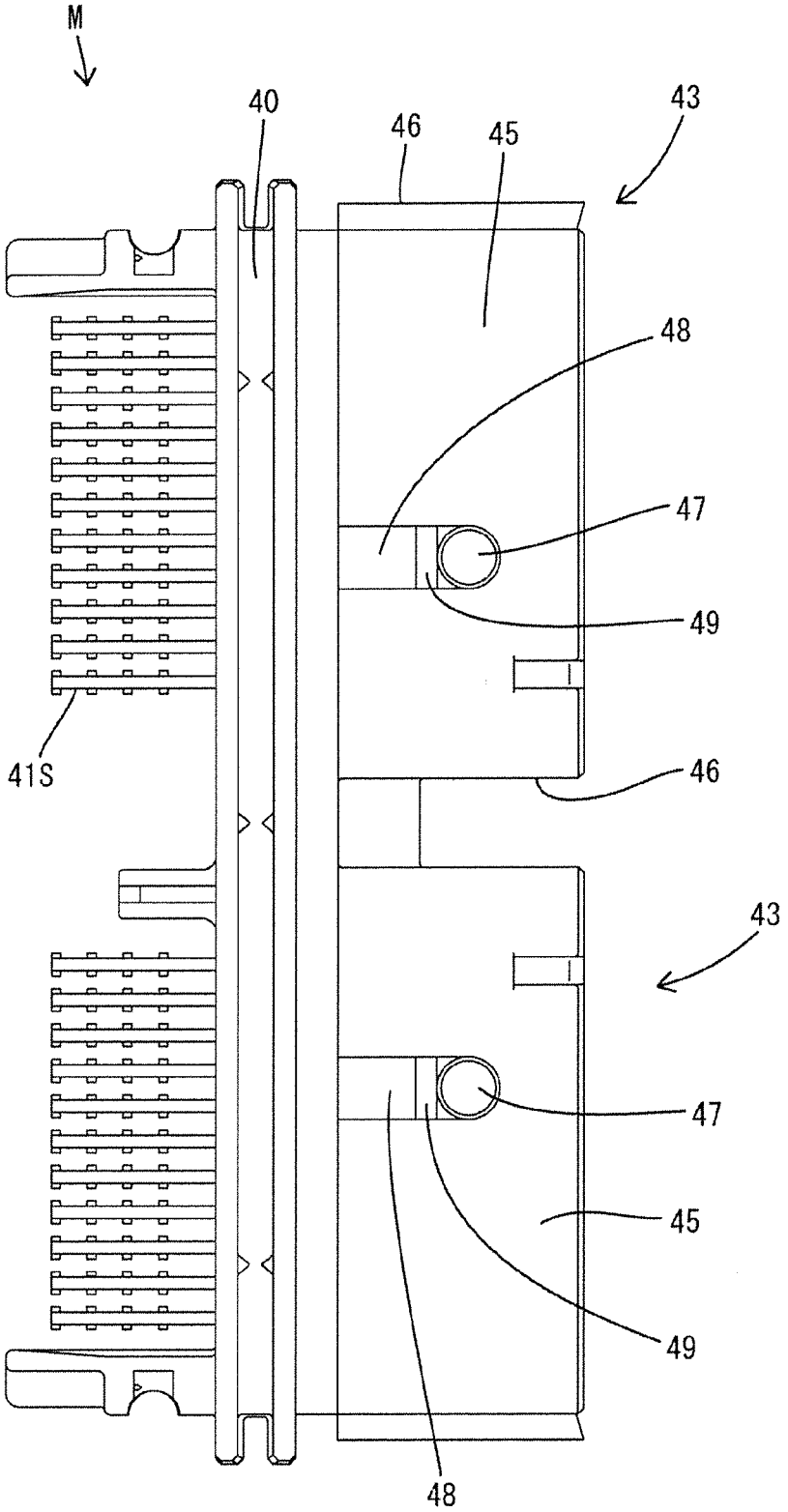
FIG. 2 is a plan view of a male housing.

As shown in FIG. 2, the male housing M is formed unitarily to include one terminal holding portion 40 and two bilaterally symmetrical receptacles 43. The terminal holding portion 40 faces the front end surface of the terminal accommodating portion 10 with the two housings F, M connected. Each receptacle 43 is a substantially rectangular tube and extends forward (right in FIGS. 2 to 8) from the outer peripheral edge of the terminal holding portion 40. Male terminal fittings 41L, 41S are held in the terminal holding portion 40 while penetrating in the front-back direction, such as by being press-fit.

The male terminal fittings 41L, 41S are long narrow bars and are bent substantially at a right angle when viewed laterally. Downward extending base end parts of the male terminal fittings 41L, 41S are connected to a circuit board (not shown). Tips of the male terminal fittings 41L, 41S define tabs 42L, 42S that are cantilevered forward (i.e. toward the female housing F) from the terminal holding portion 40 and are surrounded by the receptacle 43. The male terminal fittings 41L are relatively long and the male terminal fittings 42S are relatively short. The projecting front ends of the tabs 42L of the long male terminal fittings 41L are more forward than the projecting front ends of the tabs 42S of the short male terminal fittings 41S. Thus, timings at which the tabs 42L, 42S and the female terminal fittings 12 start to contact differ in the process of connecting the two housings F, M.

As shown in FIG. 3, the receptacle 43 is a substantially rectangular tube formed by an inner regulating wall 44 at a lower position, a supporting wall 45 at an upper position and left and right side walls 46. The supporting wall 45 faces the inner regulating wall 44 in the vertical direction. As shown in FIGS. 2 and 3, the cylindrical cam follower 47 is aligned vertically on an outer surface of the supporting wall 45. An outer diameter of the cam follower 47 is slightly less than a width of the guide opening 22 and the opening 23.

Figure 6:
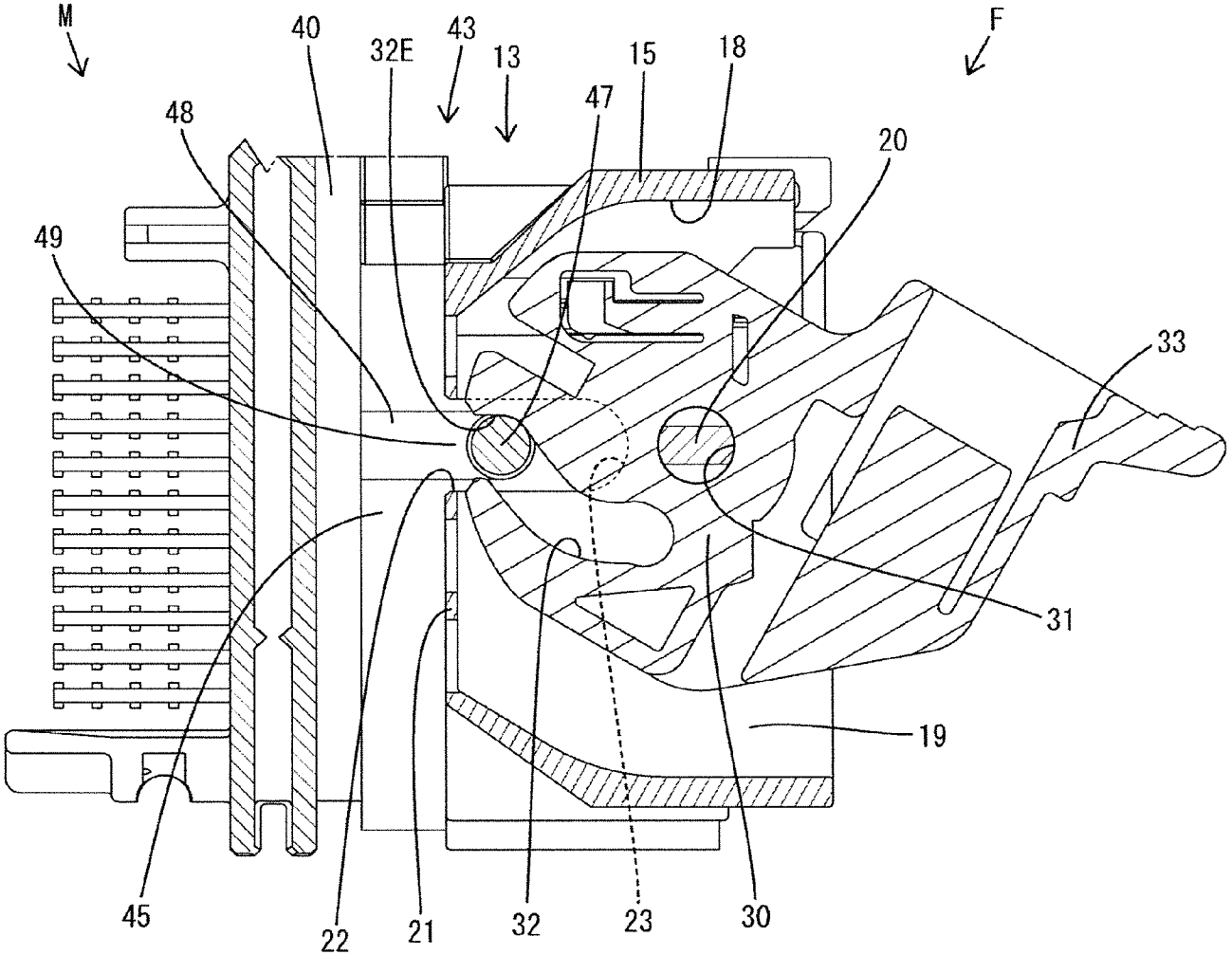
FIG. 6 is a plan view in section showing the state where the connection of the two housings is started and the cam follower is inserted in the entrance of the cam groove.
Figure 7:
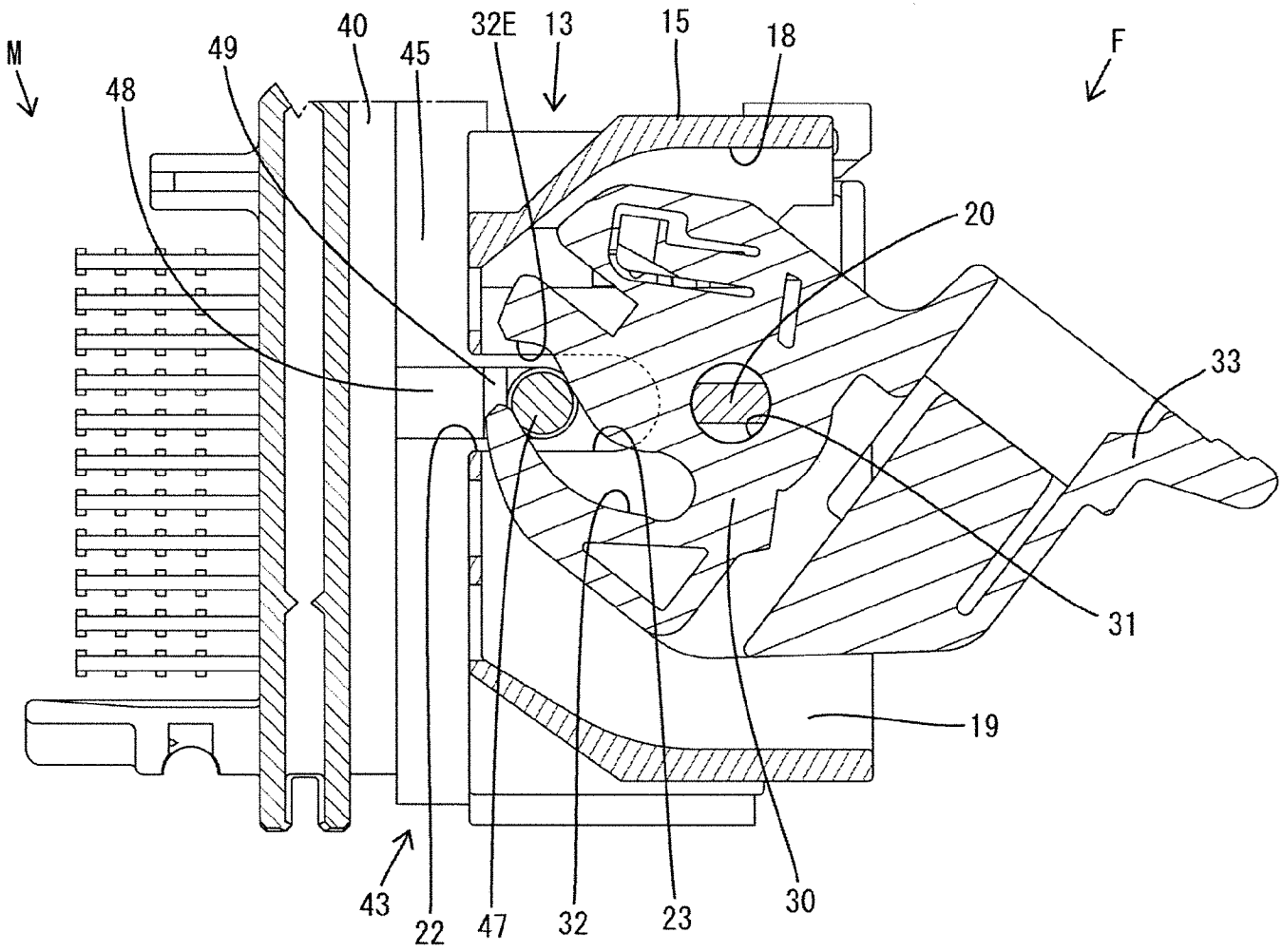
FIG. 7 is a plan view in section showing the state where the lever and the regulating protrusion are in contact to regulate the inclination of the two housings in the process of connecting the two housings.
Figure 8:
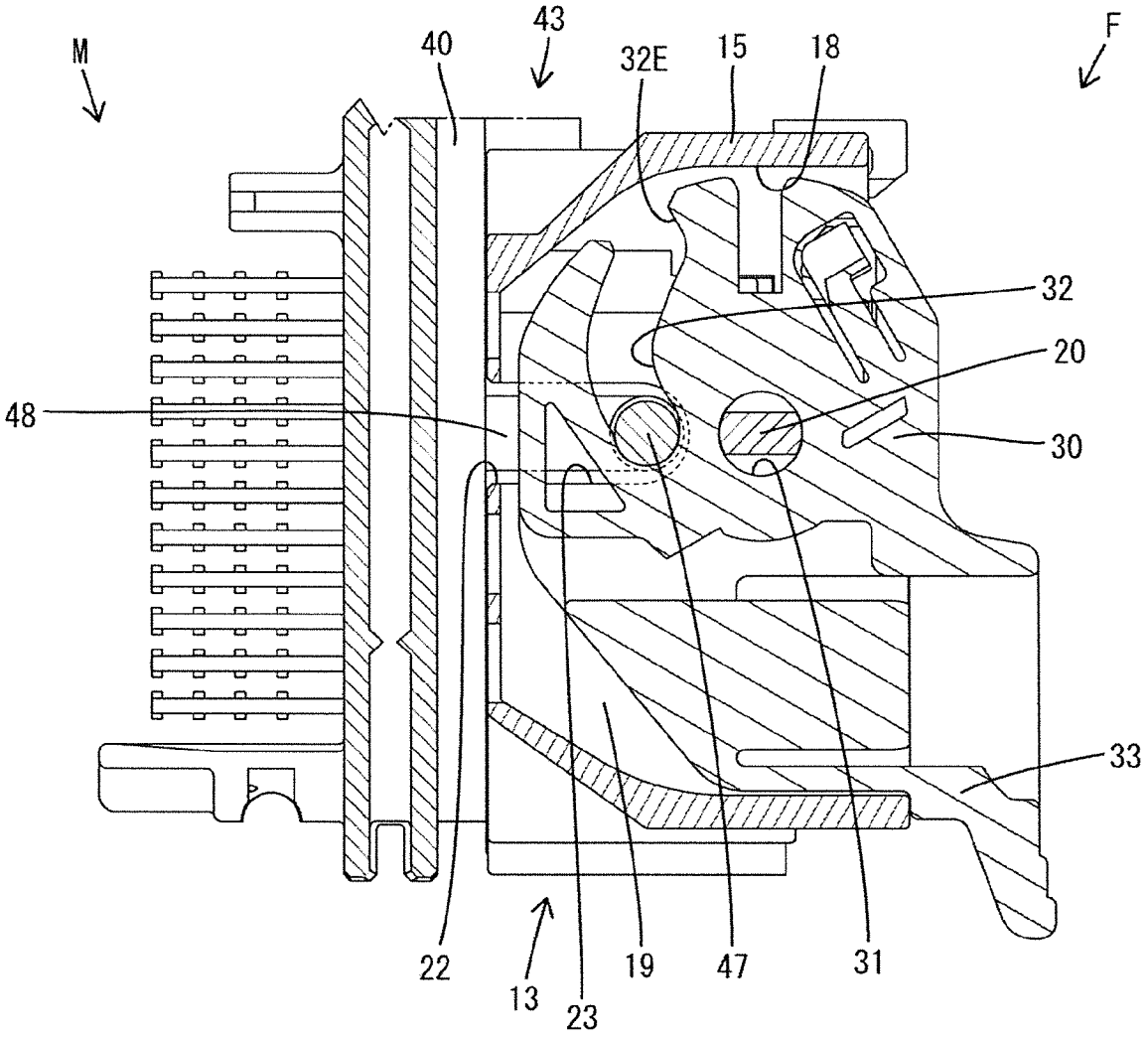
FIG. 8 is a plan view in section showing the state where the two housings are connected.

To connect the two housings F, M, the lever 30 is first set to wait at the initial position and the receptacle 41 is fit shallowly into the connection space 14. At this time, the cam follower 47 is inserted into the accommodation space 18 through the guide opening 22 and the opening 23 and, as shown in FIGS. 3 and 6, is inserted into the entrance 32E of the cam groove 32. In this way, the two housings F, M are set in an initial state. The lever 30 then is rotated from this initial state. Thus, the, engagement of the cam groove 32 and the cam follower 47 generate a cam action that pulls the two housings F, M toward each other, as shown in FIGS. 4 and 7, so that connection of the two housings F, M proceeds. During this time, the cam follower 47 moves in the opening 23, the amount of insertion of the receptacle 43 into the connection space 14 increases and the tabs 42L, 42S of the male terminal fittings 41L, 41S are inserted into the terminal accommodating portion 10 and start to contact the female terminal fittings 12. When the lever 30 reaches the connection position, the connecting operation of the two housings F, M is completed and the female terminal fittings 12 and the male terminal fittings 41L, 41S are connected electrically conductively.

The inner regulating wall 44 is arranged along the outer regulating wall 16 both in the process of inserting the receptacle 43 into the connection space 14 as the two housings F, M are being connected and also in a state where the insertion of the receptacle 43 is completed and the two housings F, M are connected. Additionally, a lower surface of the inner regulating wall 44 and an upper surface of the outer regulating wall 16 face each other. Likewise, in a state where the receptacle 43 is inserted in the connection space 14 and in a state where the insertion is completed, an upper surface of the supporting wall 45 is arranged along and faces a lower surface of the lever accommodating portion 15.

A clearance for making the connecting operation of the two housings F, M smooth is provided between the inner peripheral surface of the tubular fitting 13 and the outer peripheral surface of the receptacle 43. Further, in the process of connecting the two housings F, M, an engaged part of the cam groove 32 and the cam follower 47 precedes in upper surface parts of the two housings F, M (tubular fitting 13 and receptacle 43) and lower parts of the two housings F, M follow. Thus, the postures of the two housings F, M are going to incline during the connecting process so that the front end surfaces of the respective housings F, M face obliquely down with the contact part of the cam groove 32 and the cam follower 47 as a supporting point.

Sliding resistance between the male terminal fittings 41L, 41S and the female terminal fittings 12 increases when the inclination of the two housings F, M increases. As a result, connection resistance between the two housings F, M increases. Accordingly, the supporting wall 45 is formed with regulating protrusions 48 for suppressing the posture inclination of the two housings F, M and thereby reducing connection resistance.

The regulating protrusion 48 is in the form of a rib projecting from an outer surface (surface facing the inner surface of the wall-like accommodating portion 15) of the supporting wall 45. A projection distance of the regulating protrusion 48 from the outer surface of the supporting wall 45 is slightly longer than a thickness of the partition wall 19 of the lever accommodating portion 15. A formation area of the regulating protrusion 48 in the front-back direction (connecting direction of the two housings F, M) is a range from a position slightly before the front end of the cam follower 47 (on the right side in FIGS. 2 to 8) to the rear end of the supporting wall 45 (receptacle 43).

A guiding surface 49 is formed behind and near the cam follower 47 on the upper surface of the regulating protrusion 48 and inclines up toward the back of the receptacle 43 (to increase the projection distance from the upper surface of the supporting wall 45). A formation area of the regulating protrusion 48 in the width direction is slightly wider than the entire width of the cam follower 47 and slightly narrower than the opening widths of the guide opening 22 and the opening 23. The regulating protrusion 48 is connected to a base end part of the cam follower 47 so that the cam follower 47 projects from the upper surface of a front part of the regulating protrusion 48.

When the two housings F, M are in the initial state, the front part of the regulating protrusion 48 (formation area of the guiding surface 49) is arranged in a front part of the opening 23 and a lower end part of the guide opening 22, as shown in FIG. 6. Further, since the entrance 32E of the cam groove 32 corresponds to the regulating protrusion 48 in the width direction, the lever 30 and the regulating protrusion 48 are not in contact. At this time, all of the tabs 42L, 42S are not in contact with the female terminal fittings 12. That is, as shown in FIG. 3, the long tabs 42L are at positions proximately facing the female terminal fittings 12, but the short tabs 42S are at positions separated significantly from the female terminal fittings 12.

The lever 30 is rotated in a connecting direction from this state. A part of an outer peripheral edge part of the lever 30 (opening edge part of the entrance 32E of the cam groove 32) corresponds to the guiding surface 49 of the regulating protrusion 48 as shown in FIG. 7. At this time, as shown in FIG. 4, the tabs 42L of the long male terminal fittings 41L are in contact with the female terminal fittings 12, but the tabs 42S of the short male terminal fittings 41S are not in contact with the female terminal fittings 12. The lever 30 then is rotated further from this state so that the regulating protrusion 48 is inserted deeper into the opening 23 in the front-back direction, and the connection of the two housings F, M proceeds. The opening 23 communicates with the accommodation space 18. Thus, the upper surface of the regulating protrusion 48 is inserted into the opening 23 and faces the lower surface of the lever 30.

When the rotation of the lever 30 is started, the postures of the two housings F, M are inclined so that the front end surfaces thereof face obliquely down (not shown). When the postures of the two housings F, M are inclined, a tip outer edge 44E of the inner regulating wall 44 contacts the inner surface of the outer regulating wall 16 on lower sides of the two housings F, M. On the other hand, on upper sides of the two housings F, M, the upper surface of the regulating protrusion 48 is inserted into the opening 23 and contacts the lower surface of the lever 30 in the accommodation space 18. Any further posture inclination of the two housings F, M is regulated by this contact action on the upper and lower sides.

In the process of further rotating the lever 30 and further connecting the two housings F, M from this state, the tip outer edge 44E of the inner regulating wall 44 and the inner surface of the lower regulating wall 16 slide in contact. Furthermore the upper surface of the regulating protrusion 48 and the lower surface of the lever 30 slide in contact. During this time, a slide-contact area of the inner regulating wall 44 on the upper surface of the outer regulating wall 16 is elevated gradually as the connection of the two housings F, M proceeds. Therefore the female housing F is displaced relatively down with respect to the male housing M. On the other hand, a slide-contact position of the lever 30 with the regulating protrusion 48 hardly changes in the front-back direction. Thus, as the connection of the two housings F, M proceeds, the posture of the female housing F changes in a direction to make the inclination with respect to the male housing M smaller. When the two housings F, M are connected, the posture inclination between the two housings F, M is minimized.

Further, in the process of connecting the two housings F, M, the long tabs 42L first start to contact the female terminal fittings 12 and, subsequently, the short tabs 42S start to contact the female terminal fittings 12. Thereafter, contact resistance between the long tabs 42L and the female terminal fittings 12 is maximized and, subsequently, contact resistance between the short tabs 42S and the female terminal fittings 12 is maximized. During this time, the inclination of the two housings F, M is suppressed by the contact of the regulating protrusion 48 and the lever 30 as described above. Thus, the contact resistance between the tabs 42L, 42S (male terminal fittings 41L, 41S) and the female terminal fittings 12 also is suppressed to a smaller amount.

As described above, the lever-type connector of this embodiment includes the female housing F with the block-like terminal accommodating portion 10 and the substantially rectangular tubular fitting 13 surrounding the terminal accommodating portion 10. The lever 30 is a single plate formed with the cam groove 32 and is accommodated rotatably in the lever accommodating portion 15 of the tubular fitting 13. The male housing M includes the substantially rectangular tubular receptacle 43 and the cam follower 47 is formed on the outer surface of the receptacle 43. The two housings F, M are set in the initial state by accommodating the receptacle 43 shallowly into the connection space 14 between the terminal accommodating portion 10 and inserting the tubular fitting 13 and the cam follower 47 into the entrance 32E of the cam groove 32. The lever 30 then is rotated from the initial state, and the two housings F, M are connected by the cam action by the engagement of the cam groove 32 and the cam follower 47.

In the thus configured lever-type connector, the clearance is exists between the inner peripheral surface of the tubular fitting 13 and the outer peripheral surface of the receptacle 43 to make the connecting operation of the two housings F, M smooth. However, posture inclination may occur between the two housings F, M due to this clearance. In a state where this inclination is maximized, the tip outer edge 44E of the inner regulating wall 44 of the receptacle 43 contacts the inner surface of the outer regulating wall 16 of the tubular fitting 13 on the lower sides of the two housings F, M and the outer surface of the supporting wall 45 of the receptacle 43 contacts the slider accommodating portion 15 of the tubular fitting 13 on the upper sides of the two housings F, M. If the clearance is constant in the vertical direction, an angle of inclination becomes smaller as a distance from a base point, which is the contact position of the tip outer edge 44E of the inner regulating wall 44 and the inner surface of the outer regulating wall 16, to a contact position of the supporting wall 45 and the lever accommodating portion 15 becomes longer.

Focusing on this point, the regulating protrusion 48 projects on the outer surface of the supporting wall 45 and is insertable into the opening 23 formed on the lever accommodating portion 15 to face the lever 30 in the lever accommodating portion 15 on the upper end sides of the two housings F, M. In the process of rotating the lever 30, the tip outer edge 44E of the inner regulating wall 44 and the inner surface of the outer regulating wall 16 are brought into contact and the outer surface of the regulating protrusion 48 and the lever 30 are brought into contact. This contact at upper and lower positions suppresses inclination between the two housings F, M.

The contact position of the regulating protrusion 48 and the lever 30 is more distant from the above-described base point than the outer (upper) surface of the supporting wall 45 and a tip inner edge (lower surface) of the lever accommodating portion 15. Thus, the inclination of the housings is suppressed in the lever-type connector of this embodiment as compared with a conventional configuration in which the regulating protrusion 48 is not formed and the outer surface of the supporting wall 45 and the tip inner edge portion of the lever accommodating portion 15 contact in a maximally inclined state.

Further, since a pressing force equivalent to the connection resistance between the two housings acts on the cam follower 47 to be engaged with the cam groove 32, the cam follower 47 may be deformed to incline. However, the regulating protrusion 48 is connected to the base of the cam follower 47. Thus, the base of the cam follower 47 is reinforced and the inclination and deformation of the cam follower 47 can be prevented.

Further, the receptacle 43 is cantilevered from the terminal holding portion 40 and the regulating protrusion 48 is arranged behind the cam follower 47 in an extending direction of the receptacle 43. According to this configuration, the regulating protrusion 48 is arranged at a position closer to the base end part of the receptacle 43 than the cam follower 47. Since the base end part of the receptacle 43 has relatively high strength by being connected to the terminal holding portion 40, an area of the supporting wall 45 where the regulating protrusion 48 is formed is difficult to deform. Thus, the reliability of a function of suppressing the inclination of the two housings by the regulating protrusion 48 is excellent.

Further, the opening 23 serves as a guiding path for causing the cam follower 47 to be inserted into the lever accommodating portion 15. Thus, the strength of the lever accommodating portion 15 is high as compared with the case where a dedicated cut for causing the cam follower 47 to be inserted into the lever accommodating portion 15 is formed separately from the opening 23.

Further, the contact resistance between the female terminal fittings 12 and the male terminal fittings 41L, 41S increases as the angle of inclination between the housings F, M increases. Accordingly, the regulating protrusion 48 contacts the lever 30 before the contact resistance between the female terminal fittings 12 in the female housing F and the male terminal fittings 41L, 41S in the male housing M is maximized in the process of connecting the two housings F, M. Accordingly, the posture inclination of the two housings F, M is suppressed before the contact resistance between the female terminal fittings 12 and the male terminal fittings 41L, 41S is maximized to suppress an increase in the contact resistance between the terminal fittings.

The present invention is not limited to the above described and illustrated embodiment. For example, the following embodiments are also included in the technical scope of the present invention.

Although the regulating protrusion is connected to the base of the cam follower in the above embodiment, it may be formed in an area independent of the cam follower.

The regulating protrusion is behind the cam follower in the extending direction of the receptacle in the above embodiment, but it may be arranged at the same position as the cam follower or before the cam follower in the extending direction of the receptacle.

The opening functions as the guiding path for causing the cam follower to be inserted into the wall-like accommodating portion in the above embodiment. However, a dedicated cut for causing the cam follower to be inserted into the wall-like accommodating portion may be formed separately from the opening.

Although the regulating protrusion is a rib having a relatively small width in the above embodiment, it may have a large width. Further, in this case, a formation area of the regulating protrusion in the width direction may be an area narrower than the entire width of the supporting wall portion or an area continuous over the entire width of the supporting wall portion.

Although the regulating protrusion is brought into contact with the lever before the contact resistance between the female and male terminal fittings is maximized in the above embodiment, it may be brought into contact with the lever after the contact resistance between the female and male terminal fittings is maximized.

Although the plurality of types of male terminal fittings differing in the positions of the projecting ends of the tabs projecting toward the male housing are provided in the above embodiment, one type of male terminal fittings, the tip positions of the tabs of which are all aligned, may be provided.

Although the male housing is mounted on the circuit board in the above embodiment, it may be mounted on a wiring harness.

Although the long tabs proximately face the female terminal fittings when the regulating protrusion comes into contact with the lever in the above embodiment, there is no limitation to this and the long tabs may contact the female terminal fittings when the regulating protrusion comes into contact with the lever.

LIST OF REFERENCE SIGNS

F . . . female housing
M . . . male housing
10 . . . terminal accommodating portion
13 . . . tubular fitting portion
14 . . . connection space
15 . . . wall-like accommodating portion
16 . . . wall-like regulating portion
23 . . . opening
30 . . . lever
32 . . . cam groove
32E . . . entrance of cam groove
40 . . . terminal holding portion
43 . . . receptacle
44 . . . regulating wall portion
44E . . . tip outer edge portion of regulating wall portion
45 . . . supporting wall portion
47 . . . cam follower
48 . . . regulating protrusion

What is claimed is:

1. A lever-type connector, comprising:

a female housing including a block-like terminal accommodating portion and a substantially rectangular tubular fitting surrounding the terminal accommodating portion to define a connection space between the terminal accommodating portion and the tubular fitting, the tubular fitting having a selected wall thickness, an outer wall spaced out from the tubular fitting on one side of the female housing to define a lever accommodating portion between the outer wall and the tubular fitting;

a lever substantially in the form of a single plate formed with a cam groove and rotatably accommodated in the lever accommodating portion;

a male housing including a substantially rectangular tubular receptacle insertable into the connection space between the terminal accommodating portion and the tubular fitting of the female housing;

a cam follower formed on an outer surface of the receptacle;

the female and male housings being in an initial state when the receptacle is shallowly accommodated into the connection space between the terminal accommodating portion and the tubular fitting and the cam follower is in an entrance of the cam groove, the female and male housings being connected by a cam action by the engagement of the cam groove and the cam follower when the lever is rotated from the initial state, an outer regulating wall of the tubular fitting arranged on a side opposite to the lever accommodating portion across the terminal accommodating portion;

an inner regulating wall of the receptacle being arranged along an inner surface of the outer regulating wall;

a supporting wall of the receptacle arranged along an inner surface of the lever accommodating portion and having the cam follower projecting from an outer surface; and a regulating protrusion projecting from an outer surface of the supporting wall by a distance greater than the thickness of the tubular fitting and being inserted through an opening formed through the tubular fitting and into the lever accommodating portion for contacting the lever as the lever is rotated;

wherein the female and male housings are connected without inclination by contact of a tip outer edge of the inner regulating wall and the inner surface of the outer regulating wall and by the contact of the regulating protrusion and the lever in the process of rotating the lever.

2. The lever-type connector of claim 1, wherein the regulating protrusion is connected to a base of the cam follower.

3. The lever-type connector of claim 1, wherein:

the male housing further includes a terminal holding portion;

the receptacle projecting forward from the terminal holding portion; and the regulating protrusion is arranged behind the cam follower in an extending direction of the receptacle from the terminal holding portion.

4. The lever-type connector of claim 1, wherein the opening serves as a guiding path for causing the cam follower to be inserted into the lever accommodating portion.

5. The lever-type connector of claim 1, wherein the regulating protrusion has a width measured a width direction perpendicular to a connecting direction of the female and male housings that exceeds a width of the cam follower.

6. The lever-type connector of claim 5, wherein the opening in the tubular fitting has a width measured a width direction perpendicular to the connecting direction sufficient for slidably receiving the regulating protrusion.

* * * * *